US009356375B2

(12) United States Patent
Oka

(10) Patent No.: US 9,356,375 B2
(45) Date of Patent: May 31, 2016

(54) MALE TERMINAL FITTING

(71) Applicant: Sumitomo Wiring Systems, Ltd., Yokkaichi, Mie (JP)

(72) Inventor: Kazumi Oka, Mie (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 14/637,424

(22) Filed: Mar. 4, 2015

(65) Prior Publication Data

US 2015/0280330 A1 Oct. 1, 2015

(51) Int. Cl.
*H01R 9/24* (2006.01)
*H01R 13/08* (2006.01)

(52) U.S. Cl.
CPC ..... *H01R 13/08* (2013.01)

(58) Field of Classification Search
CPC ..... H01R 13/4223; H01R 13/4362; H01R 13/111; H01R 13/187; H01R 13/115; H01R 4/20; H01R 4/185; H01R 4/183; H01R 13/04
USPC ..... 439/595, 752, 842, 843, 849, 850, 852, 439/866, 877, 878, 884
See application file for complete search history.

(56) References Cited

U.S. PATENT DOCUMENTS 5,842,884 A 12/1998 Maegawa et al.
5,989,079 A * 11/1999 Seko ..... H01R 13/057 439/745
6,398,599 B1 * 6/2002 Irikura ..... H01R 13/04 439/271
6,752,669 B2 * 6/2004 Murakami ..... H01R 13/04 439/884
6,790,105 B2 * 9/2004 Fukatsu ..... H01R 13/055 439/884
6,866,551 B2 * 3/2005 Murakami ..... H01R 13/04 439/849
7,238,064 B2 * 7/2007 Nakamura ..... H01R 13/04 439/884
7,357,680 B2 * 4/2008 Nakamura ..... H01R 13/04 439/866
8,241,078 B2 * 8/2012 Tsuji ..... H01R 4/185 439/884

* cited by examiner

*Primary Examiner* — Thanh Tam Le
(74) *Attorney, Agent, or Firm* — Gerald Hespos; Michael Porco; Matthew Hespos

(57) ABSTRACT

A male terminal fitting includes a tubular main body (10) and a plate-like tab (40) projecting forward from the main body (10). A first support (51) and a second support (52) are provided respectively on a surface side facing in a direction of action of the external force (P1, P2) and a surface side opposite to the former surface side at a front end part of the main body (10) connected to the tab (40). The first and second supports (51, 52) serve as starting points of bending when an excessive external force (P1, P2) acts on the tab (40) in a direction intersecting with a projecting direction of the tab (40) and are displaced from each other in a front-back direction.

7 Claims, 6 Drawing Sheets

MALE TERMINAL FITTING

BACKGROUND

1. Field of the Invention

The invention relates to a male terminal fitting.

2. Description of the Related Art

U.S. Pat. No. 5,842,884 discloses a male terminal fitting with a tubular main body with a long and narrow plate-like tab projecting forward from the main body portion. The tab contacts a mating female terminal to be electrically conductively connected. The base end of the tab is coupled to the front end of the main body. The tab may bend about the coupling of the tab to the main body if an excessive external force (load) acts on the tab.

A large cross-sectional area is required at the coupling of the tab and the main body so that the tab is not sheared or bent when an external force acts on the tab in the plate thickness direction. However, increasing the cross-sectional area by increasing a plate thickness increases cost and leads to an unfavorable weight increase.

The invention aims to provide a male terminal fitting that can suppress deformation of a tab without increasing a plate thickness.

SUMMARY OF THE INVENTION

The invention is directed to a male terminal fitting formed by bending an electrically conductive metal plate to include a tubular main body and a plate-like tab. The tab projects forward from the main body and is configured for electrically contacting a mating female terminal fitting. First and second supports are provided respectively on a surface facing a direction of action of the external force and a surface opposite to the former surface at a front end of the main body that is connected to the tab. The supports serve as starting points of bending when an excessive external force acts on the tab in a direction intersecting a projecting direction of the tab. The first and second supports are displaced from each other in a front-back direction.

The first and second supports that serve as the starting points of bending of the tab are displaced in the front-back direction. Thus, a cross-sectional area (shear area) including a cutting line (shear line) connecting the first and second supports can be large and the tab is structured to be difficult to shear or bend as compared with the case where the first and second supports are at the same position in the front-back direction. Thus, the deformation of the tab can be suppressed even without increasing a plate thickness.

A straight wall and a covering wall may be provided on the surface of the main body that has the first support. The straight wall may extend continuously to the tab in the front-back direction without forming a step and the covering wall may overlie the straight wall. The first support may be at a position where the front end of the covering wall contacts the straight wall. Accordingly, an external force that acts on the tab so that the first support is to be located inside of bending causes a stress to be distributed to the straight wall and the tab becomes difficult to shear or bend. Further, it is sufficient to adjust the front end of the covering wall when setting the first support so that a degree of freedom in design is high as compared with the case where the first support is provided on the base end of the tab.

The tab is arranged eccentrically on the surface where the first support is arranged with respect to an axial center of the main body, and the second support is provided at a position to be connected at an angle to the tab before the first support.

Accordingly, the tab is difficult to shear or bend even when an external force acts so that the second support is located inside of bending.

DETAILED DESCRIPTION

Figure 1:
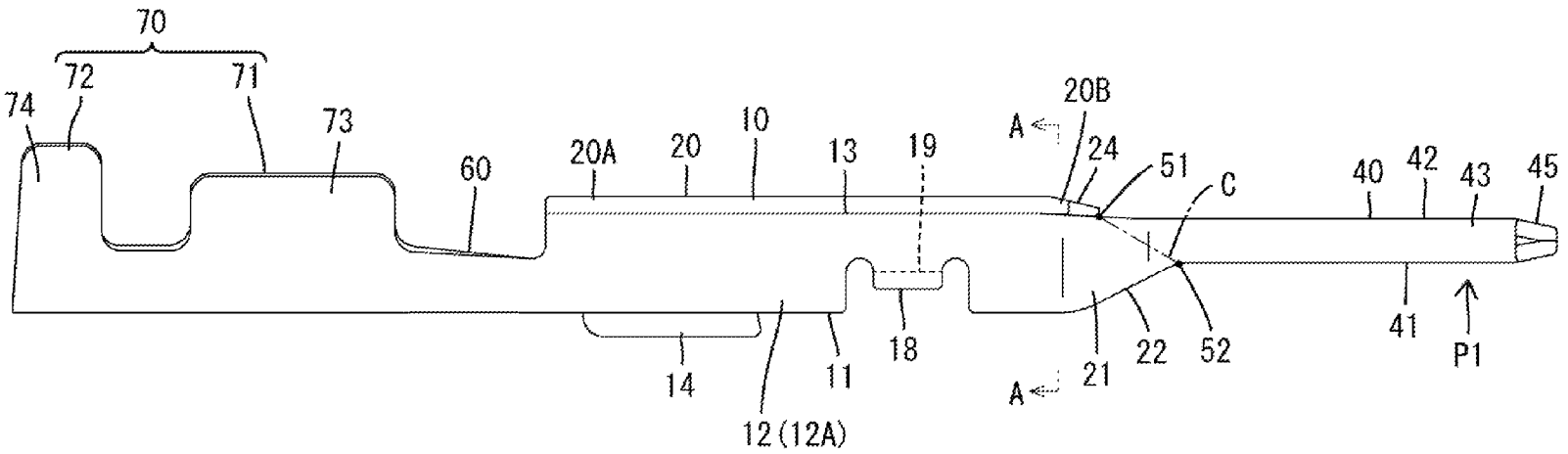
FIG. 1 is a left side view of a male terminal fitting of an embodiment of the present invention with respect to a front side of the male terminal fitting.
Figure 2:
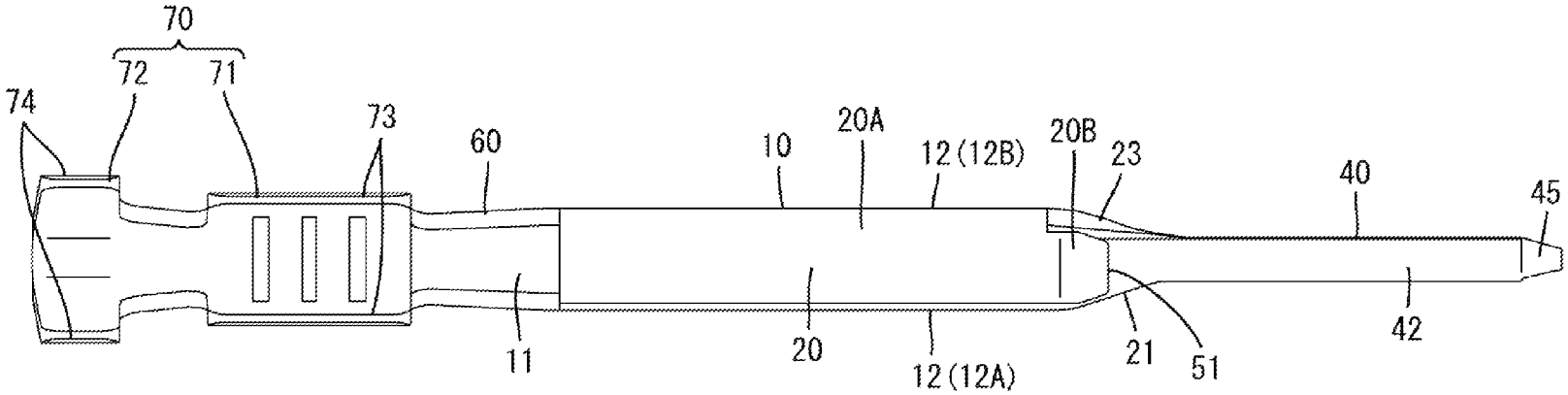
FIG. 2 is a plan view of the male terminal fitting.
Figure 5:
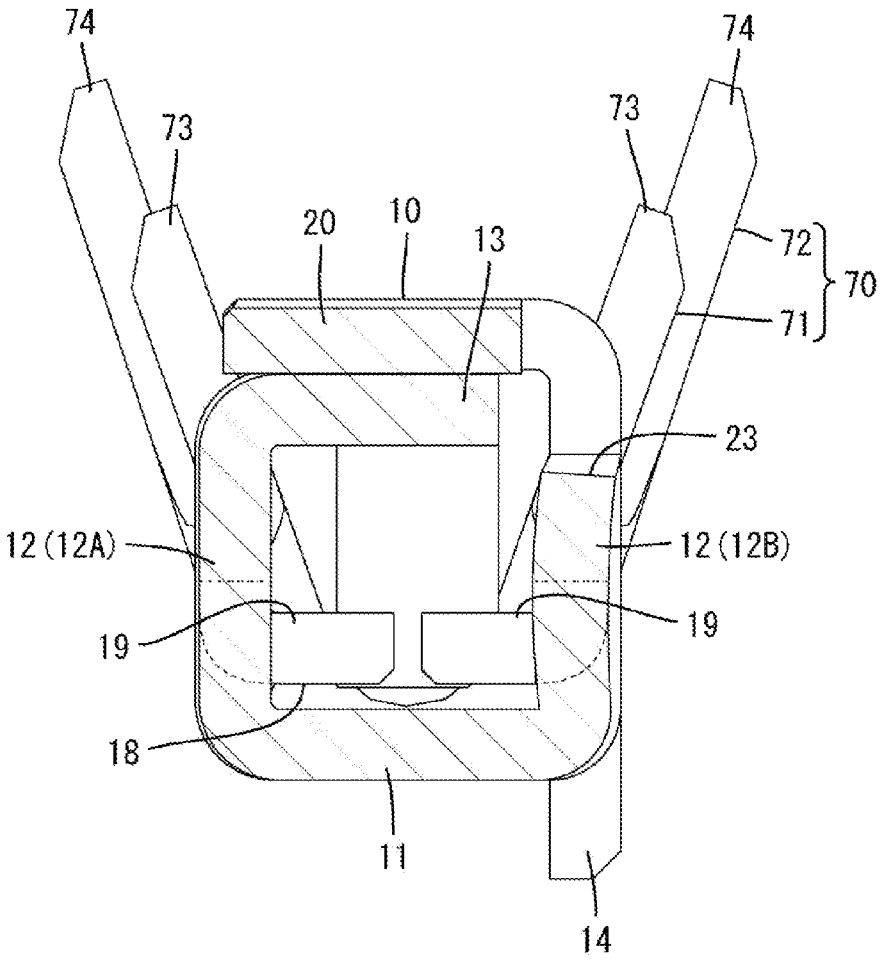
FIG. 5 is a section of the male terminal fitting.
Figure 6:
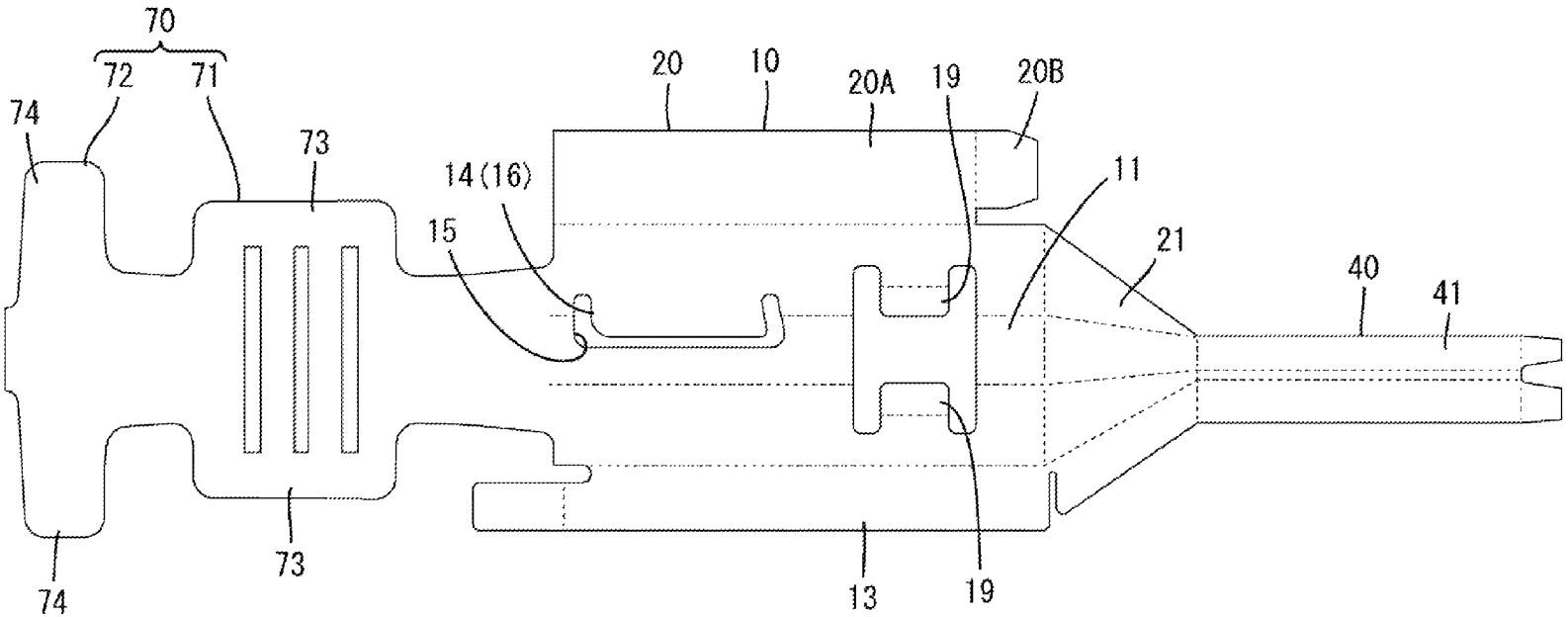
FIG. 6 is a development of the male terminal fitting.

A male terminal fitting according to an embodiment of the invention is formed by punching an electrically conductive metal plate into the shape shown in FIG. 6 and then bending the punched plate into the shape shown in FIGS. 1 to 4. Note that, in the following description, a right side in FIGS. 1 and 2 is referred to as a front end concerning a front-back direction and a vertical direction is based on FIGS. 1 and 3 to 5.

The male terminal fitting includes a substantially rectangular tubular main body 10, a tab 40 projecting forward from the main body 10 and formed by folding a plate in two, an open barrel 70 behind the main body 10 and a U-shaped coupling 60 extending between and couples the barrel 70 and the main body 10. The male terminal fitting includes a strip-like base wall 11 provided in the entire area from the tab 40 to the barrel 70.

Figure 4:
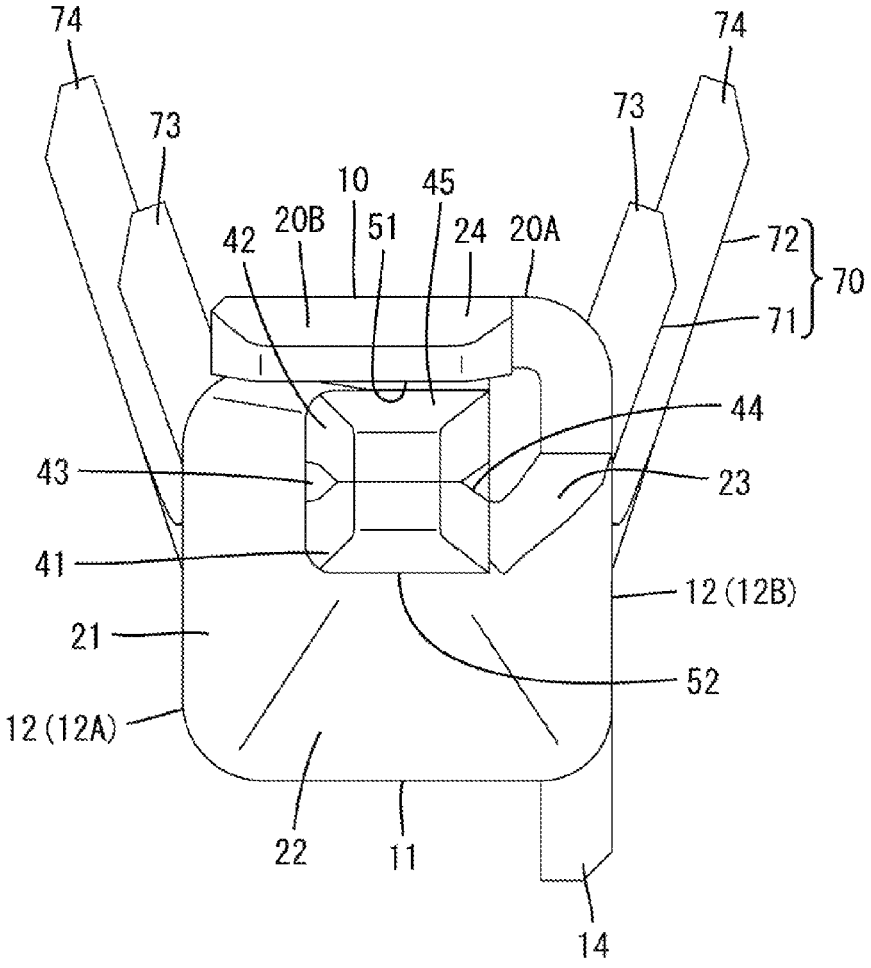
FIG. 4 is a front view of the male terminal fitting.

The barrel 70 is connected to an end part of an unillustrated wire and includes a wire barrel 71 and an insulation barrel 72 located behind the wire barrel 71. As shown in FIGS. 2, 4 and 5, the wire barrel 71 includes two wire barrel pieces 73 standing from opposite sides of the base wall 11 and is crimped and connected to a core exposed by removing a coating at the end part of the wire by winding the wire barrel pieces 73 around the core. The insulation barrel 72 includes two insulation barrel pieces 74 standing from the opposite sides of the base wall 11 and is crimped and connected to the coating at the end part of the wire by winding the insulation barrel pieces 74 around the coating.

The main body 10 has first and second side walls 12A and 12B that are referred to collectively by the numeral 12. The side walls 12A and 12B extend from the opposite sides of the base wall 11, as shown in FIG. 5. A straight wall 13 projects from the upper end of the first side wall 12A toward the second side wall 12B and is substantially parallel to the base wall 11. A covering wall 20 extends from the upper end of the second side wall 12B toward the first side wall 12A to overlay the upper surface of the straight wall 13. The straight wall 13 extends straight in the front-back direction and is connected to the tab 40.

A stabilizer 14 projects down from the second side wall 12B and is formed by making a substantially U-shaped cut 15 in the base wall 11 before bending to define a plate piece 16 (see FIG. 6). The stabilizer 14 guides an insertion of the terminal fitting into an unillustrated connector housing and prevents insertion in an incorrect posture.

Figure 3:
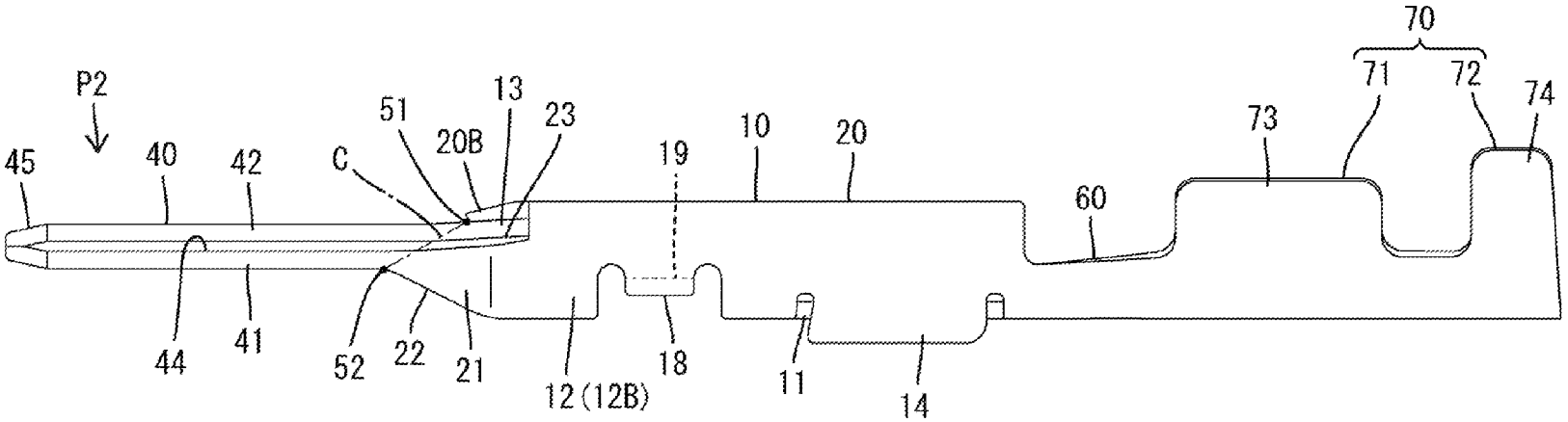
FIG. 3 is a right side view of the male terminal fitting with respect to the front side of the male terminal fitting.

A lance receiving portion 18 is formed in the base wall 11 and lower ends of the side walls 12 of the main body 10, as shown in FIGS. 1 and 3. The lance receiving portion 18 is defined by two closing pieces 19 that are bent to face each other at lower ends of the side walls 12, as shown in FIG. 5.

The closing pieces 19 are above parts of the base wall 11 at opposite front and rear ends of the lance receiving portion 18 so that the lance receiving portion 18 forms a recess in the base wall 11. A locking lance in the housing fits resiliently into the lance receiving portion 18 when the terminal fitting is inserted into the housing and prevents the terminal fitting from coming out of the housing.

As shown in FIGS. 1 to 4, a narrowed portion 21 is provided at a front end of the main body 10 and has a cross section that gradually narrows toward the tab 40. As shown in FIGS. 1 and 3, the straight wall 13 defines the upper surface of the narrowed portion 21 and extends continuously in the front-back direction from the main body 10 along the narrowed portion 21 to the upper surface of the tab 40 without forming any step. An inclined wall 22 slopes up from the base wall 11 of the main body 10 along the narrowed portion 21 and toward the tab 40.

As shown in FIGS. 1, 2 and 4, the first side wall 12A covers the entire area of the narrowed portion 21 from the base wall 11 to the straight wall 13 and is continuous with a coupling wall 43 of the tab 40. Contrary to this, as shown in FIGS. 2 to 4, the second side wall 12B has an inclined edge 23 that is separated from the tab 40 along the narrowed portion 21 and inclines up from the base wall 11 to a main panel 20A of the covering wall 20.

The main panel 20A of the covering wall 20 is a rectangular plate entirely covering a range from a front part to the rear end of the straight wall 13, as shown in FIGS. 1 and 2, and a projecting tongue 20B projects forward from the front end of the main panel 20A. As shown in FIG. 1, the projecting tongue 20B is made gradually thinner toward a front end to define an inclined outer surface 24. The front end of the projecting tongue 20B is rearward of the front end of the inclined wall 22 of the narrowed portion 21. Further, the projecting piece 20B and the main panel 20A of the covering wall 20 closely contact the upper surface of the straight wall 13.

As shown in FIGS. 1 and 4, the tab 40 is composed of a lower wall 41 extending forward at an angle from the front end of the inclined wall 22 of the narrowed portion 21, an upper wall 42 extending continuously in substantially the same plane as the straight wall 13 and the coupling wall 43 that vertically connects one side of the lower wall 41 and one side of the upper wall 42. The lower wall 41 is the base wall 11 of the tab 40.

As shown in FIG. 3, the lower wall 41 and the upper wall 42 face each other across a small clearance 44 except at a front end part. A guide 45 is formed by bending a front end part of the lower wall 41 up and bending a front end part of the upper wall 42 down to butt the front ends of the lower wall 41 and the upper wall 42 against each other at the front of the tab 40. The guide 45 guides the tab 40 smoothly into an unillustrated mating connector housing and into a box portion of an unillustrated mating female terminal fitting so that contact portions of the female terminal electrically contact the lower surface of the lower wall 41 and the upper surface of the upper wall 42.

An excessive external force P1, P2 (load) may be applied to the tab 40 along the vertical direction, and hence in a direction intersecting a projecting direction of the tab 40 and a direction in which the lower wall 41 and the upper wall 42 are placed one over the other. Thus, the tab 40 may bend about a first support 51 and a second support 52 on the front end of the main body 10.

The first support 51 is at a position where the front edge of the projecting tongue 20B of the covering wall 20 contacts the upper surface of the straight wall 13, as shown in FIGS. 1-4. On the other hand, the second support 52 is along a front end of the lower surface of the inclined wall 22 of the narrowed portion 21 where the base end of the tab 40 is bent and connected, as shown in FIGS. 1, 3 and 4. Thus, the first and second supports 51, 52 are arranged on opposite surfaces and are displaced from each other in the front-back direction. Specifically, as shown in FIGS. 1 and 3, the second support 52 is located before the first support 51.

An external force P1 that acts from below to push the tab 40 up (see FIG. 1), could cause the tab 40 to bend so that the second support 52 arranged on a lower surface and facing a direction of action of the external force P1 is located outside of bending and the first support 51 arranged on an upper surface and opposite to the second support 52 is located inside of bending. Further, an external force P2 could act from above to push the tab 40 down (see FIG. 3), and could cause the tab 40 to bend so that the first support 51 arranged on the upper surface and facing in a direction of action of the external force P2 is located outside of bending and the second support 52 arranged on the lower surface opposite to the first support 51 is located inside of bending.

However, a cutting line C (shear line) connecting the first and second supports 51, 52 extends oblique to the vertical direction, and is longer than if the cutting line C extends vertically. Thus, a cross-sectional area (shear area) including the cutting line C is larger than that along the vertical direction and the tab 40 becomes more difficult to shear or bend by that much. Therefore, unless an excessive external force P1, P2 acts, the tab 40 is neither sheared nor bent.

Further, a stress is distributed in the entire area of the straight wall 13 when the external force P1 to push up the tab 40 acts. Thus, the shear or bend of the tab 40 is suppressed so that the first support 51 is located inside of bending. In addition, by adjusting a projecting amount of the projecting tongue 20B from the covering wall main body 20A, the position of the first support 51 can be adjusted, so a distance between the first and second supports 51, 52 can be long. Thus, the tab 40 can be structured to be even more difficult to shear or bend.

Furthermore, the second support 52 is located before the first support 51. Thus, a bending moment created at the second support 52 can be suppressed when the external force P2 to push down the tab 40 acts, and the shear or bend of the tab 40 is suppressed so that the second support 52 is located inside of bending. Thus, according to this embodiment, the tab 40 is structured to be difficult to deform even if the external force P1, P2 acts on the tab 40 in the vertical direction. As a result, the deformation of the tab 40 can be suppressed even without increasing a plate thickness.

The invention is not limited to the above described and illustrated embodiment. For example, the following modes also are included in the scope of the invention.

The tab may be in the form of a single plate.

The projecting piece may be omitted from the covering wall and the first supporting point may be specified by a position where the front end of the main panel of the covering wall contacts the straight wall.

The first supporting point may be located before the second supporting point.

LIST OF REFERENCE SIGNS

10 . . . main body
11 . . . base wall
13 . . . straight wall
20 . . . covering wall
20B . . . projecting tongue

21 . . . narrowed portion
40 . . . tab
51 . . . first support
52 . . . second support
P1, P2 . . . external force

What is claimed is:

1. A male terminal fitting having opposite front and rear ends and being formed by bending an electrically conductive metal plate, the male terminal fitting comprising:

a tubular main body having a straight wall, a base wall opposed to the straight wall and a covering wall overlaying a surface of the straight wall opposite the base wall;

a plate-like tab projecting forward from the main body in a front-back direction, the tab including an upper wall extending continuously forward from the straight wall in the front-back direction and being in a common plane with the straight wall without forming a step;

a tongue projecting forward at a front end of the covering wall contacting the straight wall to define a first support; and an inclined wall sloping from the base wall of the main body and joining lower wall of the tab to define a second support, wherein the first and second supports serve as starting points of bending when an excessive external force acts on the tab in a direction intersecting a projecting direction of the tab, and the first and second supports are displaced from each other in a front-back direction.

2. The male terminal fitting of claim 1, wherein the tab is arranged eccentrically toward the surface with the first support with respect to an axial center of the main body and the second support is provided at a position to be connected at an angle to the tab before the first support.

3. A male terminal fitting formed by bending an electrically conductive unitary metal plate, comprising:

a tubular main body having a base wall, first and second side walls extending from opposite sides of the base wall, a straight wall extending from the first side wall toward the second side wall and substantially parallel to the base wall and a covering wall extending from the second side wall and covering at least part of the straight wall;

a narrowed portion provided at a front end of the main body and being defined by the straight wall and an inclined wall that extends obliquely forward from the base wall and converges toward the straight wall; and a tab including a lower wall projecting unitarily forward from the inclined wall and an upper wall projecting unitarily forward from the straight wall without a step between the straight wall and the upper wall of the tab, a front end of the covering wall contacting the upper wall of the tab at a first support that is rearward of a second support where the inclined wall joins the lower wall of the tab.

4. The terminal fitting of claim 3, further comprising a coupling wall unitarily joining the lower and upper walls of the tab.

5. The terminal fitting of claim 3, wherein the upper wall of the tab is unitary and substantially coplanar with the straight wall of the main body projecting forward from the main body.

6. The male terminal fitting of claim 3, wherein the tab is arranged eccentrically toward the surface with the first support with respect to an axial center of the main body.

7. The male terminal fitting of claim 3, wherein the inclined wall is connected at an angle to the lower wall of the tab.

* * * * *